US011560903B2

(12) United States Patent
Kobayashi et al.

(10) Patent No.: US 11,560,903 B2
(45) Date of Patent: Jan. 24, 2023

(54) ROTARY MACHINE

(71) Applicant: MITSUBISHI HEAVY INDUSTRIES COMPRESSOR CORPORATION, Tokyo (JP)

(72) Inventors: Masahiro Kobayashi, Hiroshima (JP); Hideki Nagao, Hiroshima (JP); Hiroyuki Miyata, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 26 days.

(21) Appl. No.: 17/152,044

(22) Filed: Jan. 19, 2021

(65) Prior Publication Data

US 2021/0239131 A1 Aug. 5, 2021

(30) Foreign Application Priority Data

Feb. 3, 2020 (JP) ..... JP2020-016565

(51) Int. Cl.
*F04D 29/52* (2006.01)
*F04D 29/041* (2006.01)
*F04D 29/58* (2006.01)

(52) U.S. Cl.
CPC ..... *F04D 29/52* (2013.01); *F04D 29/0413* (2013.01); *F04D 29/58* (2013.01)

(58) Field of Classification Search
CPC ..... F04D 29/041; F04D 29/5826
See application file for complete search history.

(56) References Cited

U.S. PATENT DOCUMENTS 3,202,341 A * 8/1965 La Fleur ..... F01D 25/265 417/408
5,555,745 A * 9/1996 Agahi ..... F25B 9/004 62/401
5,626,459 A * 5/1997 Cosby ..... F02C 1/10 416/198 A
7,823,398 B2 * 11/2010 Glen ..... F01C 11/004 62/401

(Continued)

FOREIGN PATENT DOCUMENTS

CN 103649465 A 3/2014
CN 106062316 A 10/2016

(Continued)

*Primary Examiner* — Kayla McCaffrey
(74) *Attorney, Agent, or Firm* — Osha Bergman Watanabe & Burton LLP

(57) ABSTRACT

A rotary machine includes a compression section that is disposed between the pair of radial bearings in a casing and compresses a fluid, an expansion section that is disposed side by side with the compression section and expands the fluid, and a thrust bearing that is disposed at a position close to a first end portion or a second end portion of a rotary shaft in an axial direction with respect to the compression section and the expansion section. Among a compression section suction port, a compression section discharge port, an expansion section suction port, and an expansion section discharge port, the compression section suction port is disposed at a position closest to the first end portion in the axial direction, and the expansion section discharge port is disposed at a position closest to the second end portion in the axial direction.

16 Claims, 3 Drawing Sheets

(56) References Cited

U.S. PATENT DOCUMENTS

| | | | | |
|---|---|---|---|---|
| 8,878,372 | B2 * | 11/2014 | Bardon | F25J 1/0257 290/1 A |
| 9,945,291 | B2 * | 4/2018 | Tsutsumi | F16C 33/10 |
| 10,982,713 | B2 * | 4/2021 | Ertas | F16C 32/0614 |
| 11,067,096 | B2 * | 7/2021 | Berti | F01D 25/16 |
| 2010/0287934 | A1 * | 11/2010 | Glynn | F28D 20/026 60/645 |
| 2012/0087778 | A1 | 4/2012 | Nagao et al. | |
| 2012/0107108 | A1 | 5/2012 | Nagao et al. | |
| 2013/0091869 | A1 | 4/2013 | Bardon et al. | |
| 2014/0126994 | A1 | 5/2014 | Ishikawa et al. | |
| 2017/0023011 | A1 | 1/2017 | Berti et al. | |
| 2019/0293117 | A1 | 9/2019 | Ertas et al. | |

FOREIGN PATENT DOCUMENTS

| | | | |
|---|---|---|---|
| CN | 110080989 | A | 8/2019 |
| JP | 2011-043070 | A | 3/2011 |
| JP | 2011-043071 | A | 3/2011 |
| WO | 2015/135878 | A1 | 9/2015 |

* cited by examiner

ROTARY MACHINE

BACKGROUND OF THE INVENTION

Field of the Invention

The present disclosure relates to a rotary machine.

Priority is claimed on Japanese Patent Application No. 2020-016565, filed on Feb. 3, 2020, the content of which is incorporated herein by reference.

Description of Related Art

United States Patent Application, Publication No. 2013/0091869 discloses a rotary machine (integral compression expander) having a configuration where a compression section that has an impeller compressing a fluid and an expansion section that has an impeller expanding the fluid are provided on one rotary shaft in a casing. In this configuration, the rotary shaft is supported to be rotatable about an axis by a pair of bearings. The impeller of the compression section is fixed to the rotary shaft between the pair of bearings. There is one impeller for the expansion section and is disposed such that one of the pair of bearings is interposed between the impeller of the expansion section and the impeller of the compression section. That is, the impeller of the expansion section is disposed to overhang at a position deviated to an outer side from between the pair of bearings, not between the pair of bearings.

SUMMARY OF THE INVENTION

However, each impeller is a heavy object. For this reason, as disclosed in United States Patent Application, Publication No. 2013/0091869, there is a possibility that the rotor dynamics of the rotary shaft decline in a configuration where the impeller of the expansion section is fixed to the rotary shaft at a position deviated to the outer side from between the pair of bearings. In addition, there is one impeller for the expansion section disclosed in United States Patent Application, Publication No. 2013/0091869. However, in a case where a plurality of impellers are necessary for the expansion section, there is a possibility that the rotor dynamics of the rotary shaft further decline and is not established as a rotary machine when the plurality of impellers for the expansion section are provided at positions deviated to the outer side from between the pair of bearings.

The present disclosure provides a rotary machine that can improve the rotor dynamics of a rotary shaft.

According to an aspect of the present disclosure, there is provided a rotary machine including a rotary shaft that is configured to rotate about an axis, a casing that covers the rotary shaft, a pair of radial bearings that is fixed to the casing and supports the rotary shaft to be rotatable about the axis, a compression section that is disposed between the pair of radial bearings in an axial direction, in which the axis extends, in the casing and is configured to compress a fluid introduced from an outside of the casing, an expansion section that is disposed side by side with the compression section, between the pair of radial bearings in the axial direction, in the casing and is configured to expand a fluid introduced from the outside of the casing, and a thrust bearing that is disposed at a position close to a first end portion or a second end portion of the rotary shaft in the axial direction with respect to the compression section and the expansion section and supports the rotary shaft in the axial direction. The compression section includes at least one compression impeller that is fixed to the rotary shaft and is configured to rotate integrally with the rotary shaft to compress the fluid which has flowed inside. The expansion section includes at least one expansion impeller that is fixed to the rotary shaft and is configured to rotate integrally with the rotary shaft to expand the fluid which has flowed inside. The casing has a compression section suction port that is configured to cause the fluid, of which a pressure is lowest in the compression section, to be introduced into the compression section, a compression section discharge port that is configured to cause the fluid, which is compressed by the compression section and has a highest pressure in the compression section, to be exhausted to an outside of the casing, an expansion section suction port that is configured to cause the fluid, of which a pressure is highest in the expansion section, to be introduced into the expansion section, and an expansion section discharge port that is configured to cause the fluid, which is expanded by the expansion section and has a lowest pressure in the expansion section, to be exhausted to the outside of the casing. Among the compression section suction port, the compression section discharge port, the expansion section suction port, and the expansion section discharge port, the compression section suction port is disposed at a position closest to the first end portion in the axial direction, and the expansion section discharge port is disposed at a position closest to the second end portion in the axial direction.

With the rotary machine of the present disclosure, it is possible to improve the rotor dynamics of the rotary shaft.

DETAILED DESCRIPTION OF THE INVENTION

Hereinafter, an embodiment for a rotary machine according to the present disclosure will be described with reference to the attached drawings. However, the present disclosure is not limited to the embodiment only.

(Configuration of Rotary Machine)

Figure 1:
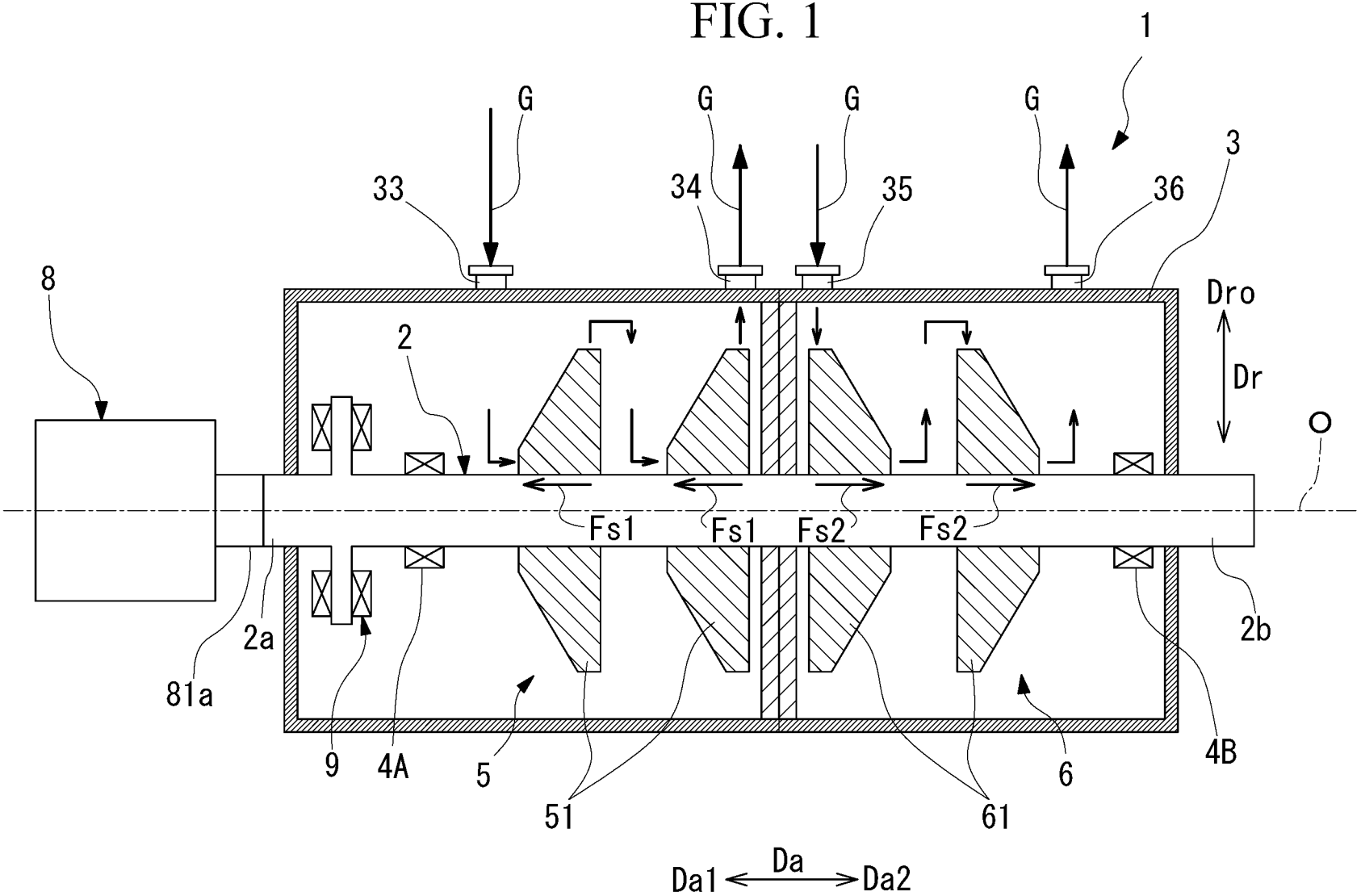
FIG. 1 is a schematic view illustrating a configuration of a rotary machine according to an embodiment of the present disclosure.

Hereinafter, the rotary machine according to the embodiment of the present disclosure will be described with reference to FIG. 1. As illustrated in FIG. 1, a rotary machine 1 is a so-called compander including a compression section 5 that functions as a compressor compressing a gas G and an expansion section 6 that functions as an expander expanding the gas G. The rotary machine 1 mainly includes a rotary shaft 2, a casing 3, a pair of radial bearings 4A and 4B, the compression section 5, the expansion section 6, and a thrust bearing 9.

(Configuration of Casing)

The casing 3 forms the outer shell of the rotary machine 1. The casing 3 is formed in a tubular shape extending in an axial direction Da in which an axis O of the rotary shaft 2 extends. The casing 3 covers part of the rotary shaft 2, the pair of radial bearings 4A and 4B, the compression section 5, and the expansion section 6. The casing 3 has a compression section suction port 33, a compression section discharge port 34, an expansion section suction port 35, and an expansion section discharge port 36.

The compression section suction port 33 is an inlet nozzle for introducing the gas (fluid) G from a gas supply source (not illustrated) outside the casing 3 into the compression section 5 inside the casing 3. The gas G having the lowest pressure in the compression section 5 passes through the compression section suction port 33. The compression section discharge port 34 is an outlet nozzle for exhausting the gas G compressed by the compression section 5 to the outside of the casing 3. The gas G, which is compressed by the compression section 5 and has the highest pressure in the compression section 5, passes through the compression section discharge port 34. The expansion section suction port 35 is an inlet nozzle for introducing the gas G into the expansion section 6. The gas G having the highest pressure in the expansion section 6 passes through the expansion section suction port 35. The expansion section discharge port 36 is an outlet nozzle for exhausting the gas G expanded by the expansion section 6 to the outside of the casing 3. The gas G, which is expanded by the expansion section 6 and has the lowest pressure in the expansion section 6, passes through the expansion section discharge port 36.

In the present embodiment, the compression section suction port 33, the compression section discharge port 34, the expansion section suction port 35, and the expansion section discharge port 36 are disposed side by side in this order in the axial direction Da from a first end portion 2*a* of the rotary shaft 2 toward a second end portion 2*b* of the rotary shaft 2. That is, among the compression section suction port 33, the compression section discharge port 34, the expansion section suction port 35, and the expansion section discharge port 36, the compression section suction port 33 is disposed at a position closest to the first end portion 2*a* of the rotary shaft 2 in the axial direction Da. Among the compression section suction port 33, the compression section discharge port 34, the expansion section suction port 35, and the expansion section discharge port 36, the expansion section discharge port 36 is disposed at a position closest to the second end portion 2*b* of the rotary shaft 2 in the axial direction Da. In addition, among the compression section suction port 33, the compression section discharge port 34, the expansion section suction port 35, and the expansion section discharge port 36, the compression section discharge port 34 and the expansion section suction port 35 are disposed at positions closest to each other in the axial direction Da.

(Configuration of Bearing)

The pair of radial bearings 4A and 4B is fixed to the casing 3. The pair of radial bearings 4A and 4B supports the rotary shaft 2 to be rotatable about the axis O. The pair of radial bearings 4A and 4B is disposed with an interval in the axial direction Da in the casing 3. In the embodiment of the present disclosure, the radial bearing (first radial bearing) 4A is disposed on a first side Da1 in the axial direction Da in the casing 3. The radial bearing (second radial bearing) 4B is disposed on a second side Da2 in the axial direction Da in the casing 3. Herein, the first side Da1 in the axial direction Da is a side in the axial direction Da, on which the first end portion 2*a* of the rotary shaft is disposed with respect to the second end portion 2*b* of the rotary shaft. In addition, the second side Da2 in the axial direction Da is a side in the axial direction Da, on which the second end portion 2*b* of the rotary shaft 2 is disposed with respect to the first end portion 2*a* of the rotary shaft 2. Therefore, the radial bearing 4A is disposed at a position close to the first end portion 2*a* of the rotary shaft 2. The radial bearing 4B is disposed at a position close to the second end portion 2*b* of the rotary shaft 2.

The thrust bearing 9 supports the rotary shaft in the axial direction Da. The thrust bearing 9 is disposed at a position close to the first end portion 2*a* or the second end portion 2*b* of the rotary shaft in the axial direction Da compared to the compression section 5 and the expansion section 6. The thrust bearing 9 of the present embodiment is disposed at a position close to the radial bearing 4A. Specifically, the thrust bearing 9 is disposed between the first end portion 2*a* and the radial bearing 4A in the axial direction Da.

(Configuration of Rotary Shaft)

The rotary shaft 2 has a columnar shape centered on the axis O and extends in the axial direction Da. The rotary shaft 2 is capable of rotating about the axis O. The rotary shaft 2 is supported by the pair of radial bearings 4A and 4B so as to be capable of rotating with respect to the casing 3.

(Configuration of Compression Section)

The compression section 5 compresses the gas G introduced from the outside of the casing 3. The compression section 5 is disposed between the pair of radial bearings 4A and 4B in the axial direction Da in the casing 3. Between the pair of radial bearings 4A and 4B, the compression section 5 is disposed at a position near the first end portion 2*a* of the rotary shaft 2.

(Configuration of Compression Impeller)

The compression section 5 includes one or more compression impellers 51 that compress the gas G flowed inside. In the embodiment of the present disclosure, the compression section 5 includes two compression impellers 51. The compression section 5 may include three or more compression impellers 51. The plurality of compression impellers 51 are disposed at an interval in the axial direction Da. The compression impellers 51 are fixed to the rotary shaft 2, and rotate integrally with the rotary shaft 2 about the axis O. Each of the compression impellers 51 is, for example, a so-called closed impeller including a disk portion (not illustrated), a blade portion (not illustrated), and a cover portion (not illustrated). By rotating integrally with the rotary shaft 2 about the axis O, each of the compression impellers 51 transfers and compresses the gas G, which has flowed from the first side Da1 in the axial direction Da, while changing a flowing direction thereof to an outer side Dro in a radial direction Dr.

Such a compression section 5 compresses the gas G, which is sucked from the outside of the casing 3 through the compression section suction port 33, with each of the compression impellers 51. The gas G, which has become high-temperature and high-pressure by passing through the plurality of compression impellers 51 and being compressed at a plurality of stages in the compression section 5, is discharged from the compression section discharge port 34 to the outside of the casing 3.

(Configuration of Expansion Section)

The expansion section 6 expands the gas G introduced from the outside of the casing 3. The expansion section 6 is disposed between the pair of radial bearings 4A and 4B in the axial direction Da in the casing 3. The expansion section 6 is disposed on the second side Da2 in the axial direction Da with respect to the compression section 5. Between the pair of radial bearings 4A and 4B, the expansion section 6 is disposed at a position near the second end portion 2*b* of the rotary shaft 2. A space between the compression section 5 and the expansion section 6 is split up by the casing 3 so as to be separated from each other.

(Configuration of Expansion Impeller)

The expansion section 6 includes one or more expansion impellers 61 that expand the gas G flowed inside. In the embodiment of the present disclosure, the expansion section 6 includes two expansion impellers 61. The expansion section 6 may include three or more expansion impellers 61. In addition, the number of expansion impellers 61 is not limited to being the same as the number of compression impellers 51. The plurality of expansion impellers 61 are disposed on the second side Da2 in the axial direction Da with respect to the plurality of compression impellers 51. The plurality of expansion impellers 61 are disposed at an interval in the axial direction Da. The expansion impellers 61 are fixed to the rotary shaft 2. The expansion impellers 61 rotate integrally with the rotary shaft 2 about the axis O. The expansion impellers 61 each are, for example, a closed impeller like the compression impeller 51.

The expansion impeller 61 transfers and expands the gas G flowing from the outer side Dro in the radial direction Dr while changing a flowing direction thereof to the second side Da2 in the axial direction Da. At this time, as the gas G expands, a rotation force about the axis O is applied to each of the expansion impellers 61.

Such an expansion section 6 expands the gas G, which is sucked from the outside of the casing 3 through the expansion section suction port 35, with each of the expansion impellers 61. The gas G, which has become low-temperature and low-pressure by passing through the plurality of expansion impellers 61 and being expanded at a plurality of stages in the expansion section 6, is discharged from the expansion section discharge port 36 to the outside of the casing 3.

(Configuration of Drive machine)

In the embodiment of the present disclosure, the rotary machine 1 is connected to a drive machine 8. The drive machine 8 rotationally drives the rotary shaft 2 about the axis O. The drive machine 8 is, for example, a motor. The drive machine 8 is connected to the first end portion 2*a* of the rotary shaft 2 in the axial direction Da. That is, the drive machine 8 is disposed next to the rotary machine 1 so as to be positioned on an opposite side of the expansion section 6 with the compression section 5 interposed therebetween. An output shaft 81*a* of the drive machine 8 is connected to the rotary shaft 2 outside the casing 3. When the drive machine 8 is operated to rotate the output shaft 81*a* about the axis O, the rotary shaft 2 is rotationally driven about the axis O integrally with the output shaft 81*a*.

(Operational Effects)

In the rotary machine 1 having the configuration, the compression section 5 that compresses the gas G introduced from the outside of the casing 3 and the expansion section 6 that expands the gas G introduced from the outside of the casing 3 are included in one casing 3. In such a rotary machine 1, the compression impeller 51 and the expansion impeller 61 are disposed only between the pair of radial bearings 4A and 4B. Accordingly, each impeller, which is a heavy object, is not disposed on the outer side of the pair of radial bearings 4A and 4B, and the rotor dynamics of the rotary shaft 2 can be improved.

Further, in the casing 3, the compression section suction port 33, the compression section discharge port 34, the expansion section suction port 35, and the expansion section discharge port 36 are disposed side by side in this order from the first side Da1 in the axial direction Da. The expansion impeller 61 is disposed side by side with the compression section 5 between the pair of radial bearings 4A and 4B in the casing 3. Specifically, the compression impeller 51 is disposed at a position near the first side Da1 in the axial direction Da in the casing 3. In addition, the expansion impeller 61 is disposed at a position near the second side Da2 in the axial direction Da in the casing 3. That is, the compression impeller 51 and the expansion impeller 61 are disposed to face opposite directions from each other in the axial direction Da. In such a configuration, a thrust force Fs1 in the axial direction Da, which acts on the compression impeller 51 by compressing the gas G, is generated to face the first side Da1 in the axial direction Da. In addition, a thrust force Fs2 in the axial direction Da, which acts on the expansion impeller 61 by expanding the gas G, is generated to face the second side Da2 in the axial direction Da. As a result, the thrust force Fs1 acting on the compression impeller 51 and the thrust force Fs2 acting on the expansion impeller 61 cancel each other out. Accordingly, the thrust forces acting on the rotary shaft 2 can be suppressed.

A thrust force that remains as the thrust force Fs1 in the axial direction Da, which acts on the compression impeller 51 by compressing the gas G, and the thrust force Fs2 in the axial direction Da, which acts on the expansion impeller 61 by expanding the gas G, have not completely canceled each other out is suppressed by the thrust bearing 9 provided in the vicinity of the radial bearing 4A or 4B.

In addition, in the expansion section 6, the plurality of expansion impellers 61 are disposed at an interval in the axial direction Da. That is, the expansion section 6 configures a multi-stage expander. As the gas G is gradually expanded by the plurality of expansion impellers 61, the generation of a loss is suppressed when expanding the gas G, and the gas G can be efficiently expanded. In addition, in the expansion section 6, the rotary shaft 2 rotates by energy generated when the gas G expands. At this time, as the gas G is gradually expanded, the energy can be efficiently collected.

In the compression section 5, the plurality of compression impellers 51 are disposed at an interval in the axial direction Da. That is, the compression section 5 configures a multi-stage compressor. The plurality of compression impellers 51 can respond to a high discharge pressure.

The drive machine 8 is connected to the first end portion 2*a* of the rotary shaft 2. Accordingly, the rotary shaft 2 can be rotated by energy generated when the expansion section 6 expands the gas G, and the rotary shaft 2 can be assisted in generating a rotational driving force as the drive machine 8 rotationally drives the rotary shaft 2 about the axis O. In addition, the drive machine 8 is disposed on the opposite side of the expansion section 6 in the axial direction Da with the compression section 5 interposed therebetween. Therefore, the rotary shaft 2 is rotationally driven about the axis O with respect to the compression section 5 by the drive machine 8 on the first side Da1 in the axial direction Da and the expansion section 6 on the second side Da2 in the axial direction Da. Accordingly, it is possible to suppress an increase in the magnitude of stress on the rotary shaft 2 in a torsional direction about the axis O.

OTHER EMBODIMENTS

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

Figure 2:
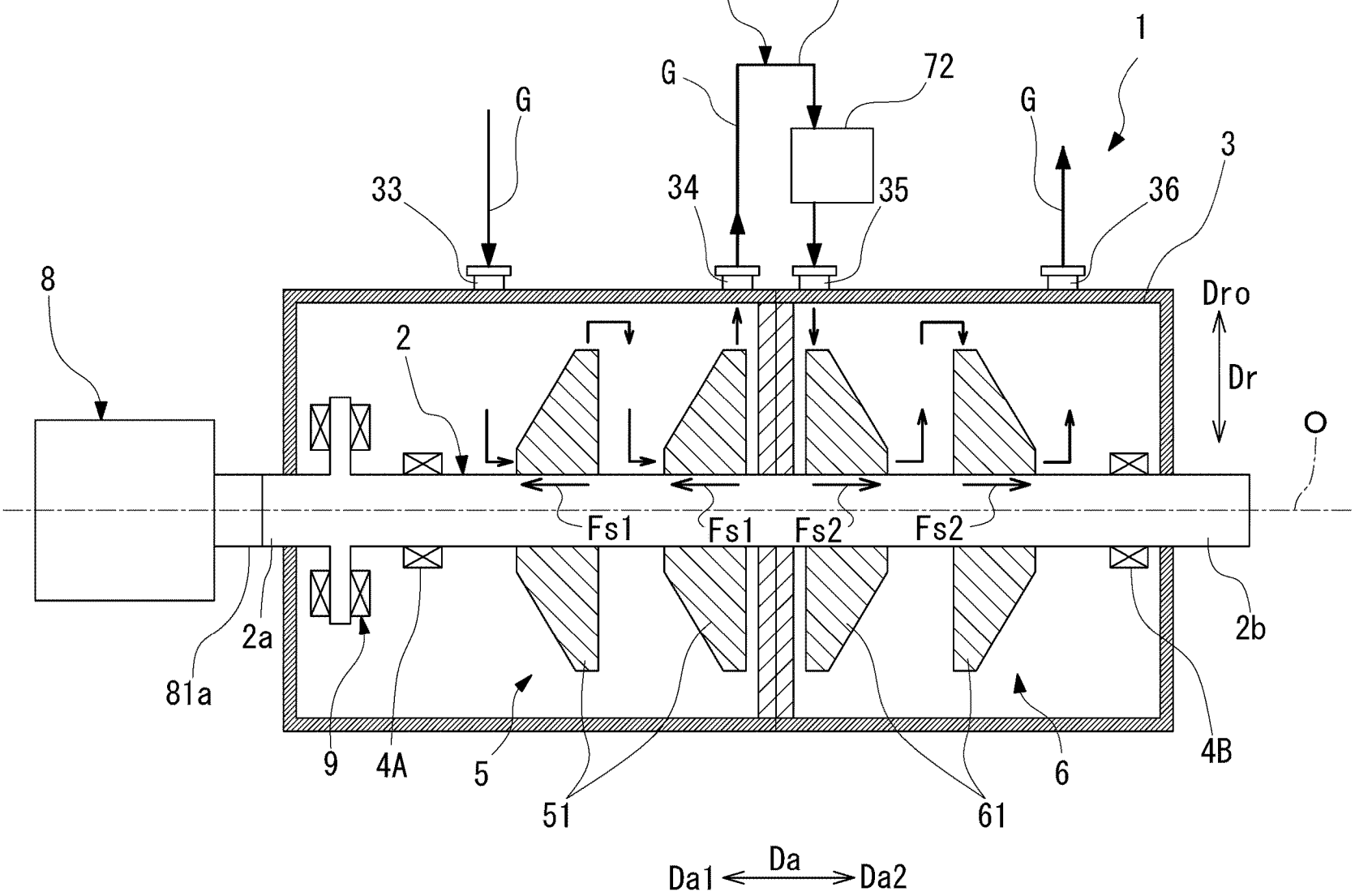
FIG. 2 is a schematic view illustrating a configuration of a rotary machine according to a first modification example of the present disclosure.

For example, as a first modification example, as illustrated in FIG. 2, the rotary machine 1 may further include a feeding unit 7 that connects the compression section discharge port 34 and the expansion section suction port 35 to each other.

(Configuration of Feeding Unit)

The feeding unit 7 is disposed between the compression section 5 and the expansion section 6. The feeding unit 7 feeds the gas G compressed by the compression section 5 in the casing 3 to the expansion section 6. The feeding unit 7 includes a feeding line 71 and a heat exchanger 72.

The feeding line 71 is a pipe that connects the compression section discharge port 34 and the expansion section suction port 35 to each other outside the casing 3. The gas G compressed by the compression section 5 in the casing 3 flows into the feeding line 71 from the compression section discharge port 34. The gas G flowed into the feeding line 71 is supplied from the expansion section suction port 35 to the expansion section 6 in the casing 3 via the heat exchanger 72.

The heat exchanger 72 is disposed in the feeding line 71. The heat exchanger 72 is capable of collecting the heat of the gas G flowing in the feeding line 71. Specifically, the heat exchanger 72 exchanges heat between the gas G flowing in the feeding line 71 and a heat medium (not illustrated). Accordingly, the temperature of the gas G, which has passed through the heat exchanger 72, declines, and the temperature of the heat medium rises.

By disposing such a feeding unit 7, the heat of the gas G, which is compressed by the compression section 5 and is yet to be fed to the expansion section 6, can be efficiently used. Specifically, the heat exchanger 72 that takes away the heat of the gas G is disposed in the feeding unit 7 that feeds the gas G compressed by the compression section 5 to the expansion section 6. Accordingly, as the heat exchanger 72 takes away the heat of the gas G, which is compressed by the compression section 5 and is high-temperature, the heat of the gas G can be effectively used. In addition, as the heat exchanger 72 collects the heat of the gas G, the temperature of the gas G declines. As the expansion section 6 expands the gas G of which a temperature has declined, the gas G has a lower temperature and a lower pressure. Therefore, the rotary machine 1 can be effectively used as, for example, a cryocooler.

In the first modification example, the purpose of the heat medium heated by exchanging heat with the gas G by the heat exchanger 72 is not limited at all.

In addition, although an example, in which the rotary machine 1 is used as a cryocooler by expanding the gas G, of which heat is taken away by the heat exchanger 72, with the expansion section 6 and making the temperature of the gas G a cryogenic temperature, has been given, the rotary machine 1 may be used for other purposes.

In addition, a structure of supplying the gas G into the casing 3 or exhausting the gas G to the outside is not limited only to the compression section suction port 33, the compression section discharge port 34, the expansion section suction port 35, and the expansion section discharge port 36. For example, the rotary machine 1 may have another suction port or discharge port between the compression section suction port 33 and the compression section discharge port 34 in the axial direction Da. In addition, the rotary machine 1 may have another suction port or discharge port between the expansion section suction port 35 and the expansion section discharge port 36 in the axial direction Da.

Figure 3:
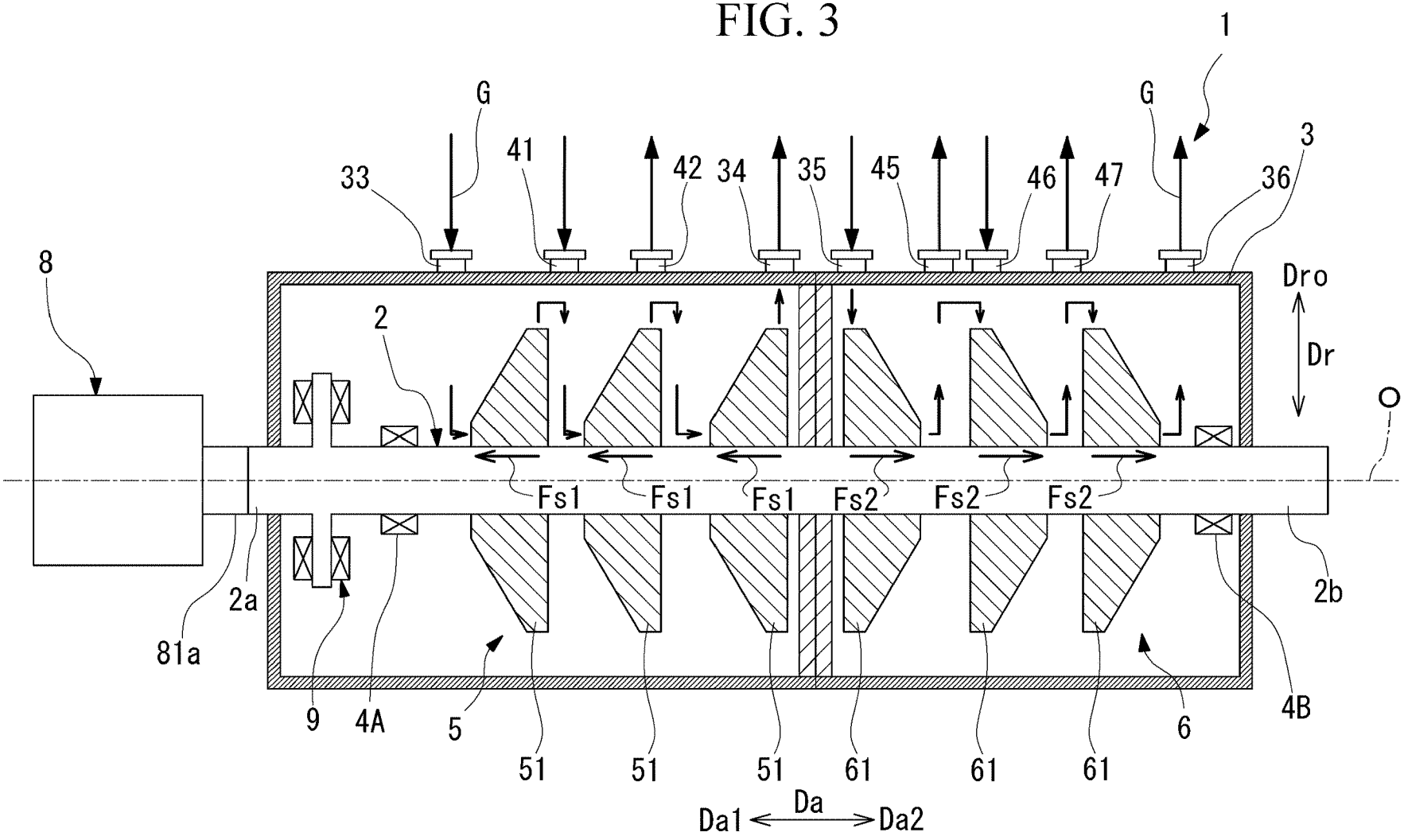
FIG. 3 is a schematic view illustrating a configuration of a rotary machine according to a second modification example of the present disclosure.

Specifically, as a second modification example, as illustrated in FIG. 3, the casing 3 has a second compression section suction port 41 and a second compression section discharge port 42, between the compression section suction port 33 and the compression section discharge port 34. The second compression section suction port 41 is on a downstream side of the compression section suction port 33, and the gas G is introduced into the middle of the compression section 5 inside the casing 3. On the downstream side of the second compression section suction port 41 and on the upstream side of the compression section discharge port 34, the second compression section discharge port 42 causes the compressed gas G to be exhausted from the middle of the compression section 5 to the outside of the casing 3.

Further, the casing 3 has a second expansion section discharge port 45, a second expansion section suction port 46, and a third expansion section discharge port 47, between the expansion section suction port 35 and the expansion section discharge port 36. On the downstream side of the expansion section suction port 35, the second expansion section discharge port 45 causes the expanded gas G to be exhausted from the middle of the expansion section 6 to the outside of the casing 3. On the downstream side of the second expansion section discharge port 45 and on the upstream side of the third expansion section discharge port 47, the second expansion section suction port 46 causes the gas G to be introduced into the middle of the expansion section 6 inside the casing 3. On the downstream side of the second expansion section suction port 46 and on the upstream side of the expansion section discharge port 36, the third expansion section discharge port 47 causes the expanded gas G to be exhausted from the middle of the expansion section 6 to the outside of the casing 3.

In addition, although the closed impeller is given as an example of the compression impeller 51 or the expansion impeller 61 in the present embodiment, the invention is not limited to such a configuration. For example, the compression impeller 51 and the expansion impeller 61 may be open impellers without a cover. In addition, in a case where the plurality of compression impellers 51 and the plurality of expansion impellers 61 are disposed, closed impellers and open impellers may be mixed.

In addition, a position where the thrust bearing 9 is disposed is not limited to the position in the present embodiment. For example, the thrust bearing 9 may be disposed between the radial bearing 4A and the compression section 5 in the axial direction Da. In addition, the thrust bearing 9 may be disposed at a position close to the radial bearing 4B. In this case, the thrust bearing 9 may be disposed between the radial bearing 4B and the expansion section 6, or between the radial bearing 4B and the second end portion 2*b*.

In addition, although a schematic configuration of each part of the rotary machine 1 has been described in the embodiment, a specific configuration thereof is not limited at all.

APPENDIX

The rotary machine 1 described in the embodiment is identified as follows, for example.

(1) The rotary machine 1 according to a first aspect includes the rotary shaft 2 that is configured to rotate about the axis O, the casing 3 that covers the rotary shaft 2, the pair of radial bearings 4A and 4B that is fixed to the casing 3 and supports the rotary shaft 2 to be rotatable about the axis O, the compression section 5 that is disposed between the pair of radial bearings 4A and 4B in the axial direction Da, in which the axis O extends, in the casing 3 and is configured to compress a fluid, which has been introduced from the outside of the casing 3, the expansion section 6 that is disposed side by side the compression section 5, between the pair of radial bearings 4A and 4B in the axial direction Da, in the casing 3 and is configured to expand the fluid introduced from the outside of the casing 3, and the thrust bearing 9 that is disposed at a position close to the first end portion 2*a* or the second end portion 2*b* of the rotary shaft 2 in the axial direction Da with respect to the compression section 5 and the expansion section 6 and supports the rotary shaft 2 in the axial direction Da. The compression section 5 includes the at least one compression impeller 51 that is fixed to the rotary shaft 2 and is configured to rotate integrally therewith to compress the fluid which has flowed inside. The expansion section 6 includes the at least one expansion impeller 61 that is fixed to the rotary shaft 2 and is configured to rotate integrally therewith to expand the fluid which has flowed inside. The casing 3 has the compression section suction port 33 that is configured to cause the fluid, of which a pressure is lowest in the compression section 5 to be introduced into the compression section 5, the compression section discharge port 34 that is configured to cause the fluid, which is compressed by the compression section 5 and has the highest pressure in the compression section 5, to be exhausted to the outside of the casing 3, the expansion section suction port 35 that is configured to cause the fluid, of which a pressure is highest in the expansion section 6, to be introduced into the expansion section 6, and the expansion section discharge port 36 that is configured to cause the fluid, which is expanded by the expansion section 6 and has the lowest pressure in the expansion section 6, to be exhausted to the outside of the casing 3. Among the compression section suction port 33, the compression section discharge port 34, the expansion section suction port 35, and the expansion section discharge port 36, the compression section suction port 33 is disposed at a position closest to the first end portion 2*a* in the axial direction Da, and the expansion section discharge port 36 is disposed at a position closest to the second end portion 2*b* in the axial direction Da.

In such a rotary machine 1, the compression impeller 51 and the expansion impeller 61 are disposed only between the pair of radial bearings 4A and 4B. Accordingly, each impeller, which is a heavy object, is not disposed on the outer side of the pair of radial bearings 4A and 4B, and the rotor dynamics of the rotary shaft 2 can be improved. Further, in the casing 3, the compression section suction port 33, the compression section discharge port 34, the expansion section suction port 35, and the expansion section discharge port 36 are disposed side by side in this order from the first end portion 2*a* in the axial direction Da. The expansion impeller 61 is disposed side by side with the compression section 5 between the pair of radial bearings 4A and 4B in the casing 3. That is, the compression impeller 51 and the expansion impeller 61 are disposed to face opposite directions from each other in the axial direction Da. In such a configuration, the thrust force Fs1 in the axial direction Da, which acts on the compression impeller 51 by compressing the fluid, is generated to face the first end portion 2*a* in the axial direction Da. In addition, the thrust force Fs2 in the axial direction Da, which acts on the expansion impeller 61 by expanding the fluid, is generated to face the second end portion 2*b* in the axial direction Da. As a result, the thrust force Fs1 acting on the compression impeller 51 and the thrust force Fs2 acting on the expansion impeller 61 cancel each other out. Accordingly, the thrust forces acting on the rotary shaft 2 can be suppressed.

(2) The rotary machine 1 according to a second aspect is the rotary machine 1 of (1), in which the at least one expansion impeller 61 comprises includes the plurality of expansion impellers 61 disposed at an interval in the axial direction Da.

As the fluid is gradually expanded by the plurality of expansion impellers 61, the generation of a loss is suppressed when expanding the fluid, and the fluid can be efficiently expanded. In addition, in the expansion section 6, the rotary shaft 2 rotates by energy generated when the fluid expands. At this time, as the fluid is gradually expanded, the energy can be efficiently collected.

(3) The rotary machine 1 according to a third aspect is the rotary machine 1 of (1) or (2), in which the at least one compression impeller 51 comprises includes the plurality of compression impellers 51 disposed at an interval in the axial direction Da.

The plurality of compression impellers 51 can respond to a high discharge pressure.

(4) The rotary machine 1 according to a fourth aspect is the rotary machine 1 of any one of (1) to (3), and further includes the feeding unit 7 that connects the compression section discharge port 34 and the expansion section suction port 35 to each other. The feeding unit 7 has the heat exchanger 72 that is configured to collect the heat of the fluid.

Accordingly, as the heat exchanger 72 takes away the heat of the fluid, which is compressed by the compression section 5 and is high-temperature, the heat of the fluid can be effectively used. In addition, as the heat exchanger 72 collects the heat of the fluid, the temperature of the fluid declines. As the expansion section 6 expands the fluid of which a temperature has declined, the fluid has a lower temperature and a lower pressure. Accordingly, the rotary machine 1 can be effectively used as, for example, a cryocooler.

(5) The rotary machine 1 according to a fifth aspect is the rotary machine 1 according to any one of (1) to (4), in which in the casing 3, the compression section suction port 33, the compression section discharge port 34, the expansion section suction port 35, and the expansion section discharge port 36 are disposed side by side in this order in the axial direction Da from the first end portion 2*a* toward the second end portion 2*b*.

EXPLANATION OF REFERENCES

1 rotary machine
2 rotary shaft
2*a* first end portion
2*b* second end portion
3 casing
4A, 4B radial bearing
5 compression section
6 expansion section
7 feeding unit
8 drive machine
9 thrust bearing
33 compression section suction port
34 compression section discharge port
35 expansion section suction port
36 expansion section discharge port
51 compression impeller
61 expansion impeller
71 feeding line
72 heat exchanger
81*a* output shaft
Da axial direction
Da1 first side Da2 second side
Dr radial direction
Dro outer side
Fs1, Fs2 thrust force
G gas (fluid)
O axis

What is claimed is:

1. A rotary machine comprising:

a rotary shaft that is configured to rotate about an axis;

a casing that covers the rotary shaft;

a pair of radial bearings that is fixed to the casing and supports the rotary shaft to be rotatable about the axis;

a compression section that is disposed between the pair of radial bearings in an axial direction, in which the axis extends, in the casing and is configured to compress a fluid introduced from an outside of the casing;

an expansion section that is disposed side by side with the compression section, between the pair of radial bearings in the axial direction, in the casing and is configured to expand the fluid introduced from the outside of the casing; and a thrust bearing that is disposed at a position close to a first end portion or a second end portion of the rotary shaft in the axial direction with respect to the compression section and the expansion section and supports the rotary shaft in the axial direction, wherein the compression section comprises compression impellers that are fixed to the rotary shaft and are configured to rotate integrally with the rotary shaft to compress the fluid which has flowed inside, the expansion section comprises expansion impellers that are fixed to the rotary shaft and are configured to rotate integrally with the rotary shaft to expand the fluid which has flowed inside, the pair of radial bearings, the compression section, the expansion section, and the thrust bearing are disposed inside the casing, a space between the compression section and the expansion section is split up by the casing and the compression section is separated from the expansion section inside the casing, the casing has a compression section suction port that is configured to cause the fluid, of which a pressure is lowest in the compression section, to be introduced into the compression section, a compression section discharge port that is configured to cause the fluid, which is compressed by the compression section and has a highest pressure in the compression section, to be exhausted to the outside of the casing, an expansion section suction port that is configured to cause the fluid, of which a pressure is highest in the expansion section, to be introduced into the expansion section, and an expansion section discharge port that is configured to cause the fluid, which is expanded by the expansion section and has a lowest pressure in the expansion section, to be exhausted to the outside of the casing, among the compression section suction port, the compression section discharge port, the expansion section suction port, and the expansion section discharge port, the compression section suction port is disposed at a position closest to the first end portion in the axial direction, and the expansion section discharge port is disposed at a position closest to the second end portion in the axial direction, and none of the pair of radial bearings and the thrust bearing is disposed between one of the compression impellers that is closest to the compression section discharge port and one of the expansion impellers that is closest to the expansion section suction port.

2. The rotary machine according to claim 1, wherein the expansion impellers are disposed at an interval in the axial direction.

3. The rotary machine according to claim 2, wherein the compression impellers are disposed at an interval in the axial direction.

4. The rotary machine according to claim 3, further comprising:

a feeding unit that connects the compression section discharge port and the expansion section suction port to each other, wherein the feeding unit has a heat exchanger that is configured to collect heat of the fluid.

5. The rotary machine according to claim 4, wherein in the casing, the compression section suction port, the compression section discharge port, the expansion section suction port, and the expansion section discharge port are disposed side by side in this order in the axial direction from the first end portion toward the second end portion.

6. The rotary machine according to claim 3, wherein in the casing, the compression section suction port, the compression section discharge port, the expansion section suction port, and the expansion section discharge port are disposed side by side in this order in the axial direction from the first end portion toward the second end portion.

7. The rotary machine according to claim 2, further comprising:

a feeding unit that connects the compression section discharge port and the expansion section suction port to each other, wherein the feeding unit has a heat exchanger that is configured to collect heat of the fluid.

8. The rotary machine according to claim 7, wherein in the casing, the compression section suction port, the compression section discharge port, the expansion section suction port, and the expansion section discharge port are disposed side by side in this order in the axial direction from the first end portion toward the second end portion.

9. The rotary machine according to claim 2, wherein in the casing, the compression section suction port, the compression section discharge port, the expansion section suction port, and the expansion section discharge port are disposed side by side in this order in the axial direction from the first end portion toward the second end portion.

10. The rotary machine according to claim 1, wherein the compression impellers are disposed at an interval in the axial direction.

11. The rotary machine according to claim 10, further comprising:

a feeding unit that connects the compression section discharge port and the expansion section suction port to each other, wherein the feeding unit has a heat exchanger that is configured to collect heat of the fluid.

12. The rotary machine according to claim 11, wherein in the casing, the compression section suction port, the compression section discharge port, the expansion section suction port, and the expansion section discharge port are disposed side by side in this order in the axial direction from the first end portion toward the second end portion.

13. The rotary machine according to claim 10, wherein in the casing, the compression section suction port, the compression section discharge port, the expansion section suction port, and the expansion section discharge port are disposed side by side in this order in the axial direction from the first end portion toward the second end portion.

14. The rotary machine according to claim 1, further comprising:

a feeding unit that connects the compression section discharge port and the expansion section suction port to each other, wherein the feeding unit has a heat exchanger that is configured to collect heat of the fluid.

15. The rotary machine according to claim 14, wherein in the casing, the compression section suction port, the compression section discharge port, the expansion section suction port, and the expansion section discharge port are disposed side by side in this order in the axial direction from the first end portion toward the second end portion.

16. The rotary machine according to claim 1, wherein in the casing, the compression section suction port, the compression section discharge port, the expansion section suction port, and the expansion section discharge port are disposed side by side in this order in the axial direction from the first end portion toward the second end portion.

* * * * *